US009352874B2

(12) United States Patent
Cance et al.

(10) Patent No.: US 9,352,874 B2
(45) Date of Patent: May 31, 2016

(54) LOW PROFILE, LIGHT WEIGHT HYBRID WOOD/PAPER PALLET

(71) Applicant: LENOVO ENTERPRISE SOLUTIONS (SINGAPORE) PTE. LTD., New Tech Park (SG)

(72) Inventors: Paul J Cance, Durham, NC (US); William J Green, Cary, NC (US); Robert W Stegner, Raleigh, NC (US)

(73) Assignee: LENOVO ENTERPRISE SOLUTIONS (SINGAPORE) PTE. LTD., Singapore (SG)

( * ) Notice: Subject to any disclaimer, the term of this patent is extended or adjusted under 35 U.S.C. 154(b) by 0 days.

(21) Appl. No.: 14/496,728

(22) Filed: Sep. 25, 2014

(65) Prior Publication Data

US 2016/0090207 A1 Mar. 31, 2016

(51) Int. Cl.
*B65D 19/00* (2006.01)
*B65D 19/06* (2006.01)

(52) U.S. Cl.
CPC ..... *B65D 19/06* (2013.01); *B65D 2519/00019* (2013.01); *B65D 2519/00034* (2013.01); *B65D 2519/00064* (2013.01); *B65D 2519/00796* (2013.01)

(58) Field of Classification Search
CPC ..... B65D 19/20; B65D 19/385; B65D 19/44; B65D 19/06; B65D 2519/00019
USPC ..... 108/51.3, 55.3, 56.3, 57.13, 57.19, 108/57.16, 57.24
See application file for complete search history.

(56) References Cited

U.S. PATENT DOCUMENTS 2,109,784 A * 3/1938 Shepard, Jr. ..... B65D 19/0075 108/57.24
2,145,093 A * 1/1939 Quayle ..... B65D 19/0075 108/57.24
2,738,058 A * 3/1956 Hansen ..... B65D 19/02 108/55.1
3,207,412 A * 9/1965 Bronte ..... B65D 5/726 229/122.2
3,285,204 A * 11/1966 Schweitzer, Jr. ... B65D 19/0095 108/53.1
3,291,364 A * 12/1966 Fischer ..... B65D 19/20 206/340
3,294,307 A * 12/1966 Munroe ..... B65D 5/446 206/600

(Continued)

FOREIGN PATENT DOCUMENTS

JP 06080632 11/1994
JP 2002166924 A 6/2002

(Continued)

OTHER PUBLICATIONS

IBM, Pallet, Part No. 72X6022, Apr. 23, 1987.

*Primary Examiner* — Hanh V Tran
(74) *Attorney, Agent, or Firm* — Kunzler Law Group

(57) ABSTRACT

An apparatus includes a pallet bottom with a first side with a first edge, a second side, a third side with a third edge, and a fourth side, where the first side is adjacent to the second side and opposite the third side and the second side is opposite the fourth side. Each side includes an opening for receiving forks. The apparatus includes a first edge board along the second side connected between the first and the third edges, a second edge board along the fourth side connected between the first and third edges, and a deck plate connected to the first and third edges. The deck plate spans between the first edge board, the second edge board, the first edge and the third edge. The deck plate engages the first and the second edge boards at least at a mid-section of the first and the second edge boards.

19 Claims, 5 Drawing Sheets

(56) References Cited

U.S. PATENT DOCUMENTS 3,633,794 A * 1/1972 Croley ..... B65D 19/20 222/528
4,614,277 A * 9/1986 Fourie ..... B65D 19/0022 108/57.17
4,714,026 A * 12/1987 Yamaguchi ..... B65D 19/0012 108/51.3
5,542,541 A * 8/1996 Smith ..... B65D 19/20 206/600
5,543,205 A 8/1996 Liebel
5,660,118 A * 8/1997 Adams, Jr. ..... B65D 19/38 108/51.3
5,836,255 A * 11/1998 Uitz ..... B65D 19/0069 108/57.25
5,934,202 A * 8/1999 Lai ..... B65D 19/0012 108/51.3
5,996,510 A * 12/1999 Harpman ..... B65D 19/0012 108/51.3
6,155,181 A * 12/2000 Chilcutt ..... B65D 19/0012 108/51.3
6,470,649 B2 10/2002 Usui et al.
6,817,586 B1 11/2004 Lin
7,905,183 B2 * 3/2011 Gibson ..... B65D 19/0022 108/51.3
8,127,929 B1 3/2012 Lu et al.
8,256,621 B2 * 9/2012 Deiger ..... B65B 11/025 108/51.3
2005/0229819 A1 10/2005 Hollander et al.
2008/0257769 A1 * 10/2008 Baechle ..... B65D 19/20 206/386
2009/0053033 A1 * 2/2009 Barbalho ..... B65D 19/0095 414/802
2011/0232537 A1 * 9/2011 Gordon ..... B65D 19/0016 108/50.11
2011/0239910 A1 * 10/2011 Chambless ..... B32B 38/0004 108/57.16
2013/0180941 A1 * 7/2013 Tomaszewski ..... B65D 19/385 211/126.12
2014/0165883 A1 * 6/2014 Staps ..... B65D 71/0096 108/55.1

FOREIGN PATENT DOCUMENTS

JP 2009132452 A 6/2009
WO 2008016328 A1 2/2008
WO 2012098514 A1 7/2012

* cited by examiner

Section AA

Section BB

Section CC

LOW PROFILE, LIGHT WEIGHT HYBRID WOOD/PAPER PALLET

FIELD

The subject matter disclosed herein relates to pallets and more particularly relates to a hybrid pallet that is lighter and thinner than typical pallets.

BACKGROUND

The vast majority of pallets made in the world are constructed of wood. Typically, wood is relatively light weight, strong, and commonly available in virtually every market and infrastructure in the world. Pallets are typically a reliable method of moving large, heavy, or consolidated products through supply chains using mechanical means (i.e. Fork lifts or pallet jacks). Because pallets are handled by these mechanical means, the pallets need to be robust enough to handle being moved by forklifts. Broken and damaged blocks and stringers are a common occurrence with pallets.

Shipping costs often depend on weight so a small decrease in weight over many loads may result in a substantial savings. Dimensional weight may also be used where weight and volume are correlated so that a reduction in volume results in a decreased shipping cost due to decreased dimensional weight.

BRIEF SUMMARY

A pallet apparatus is disclosed. The pallet apparatus includes a pallet bottom with a bottom, a first side with a first edge, a second side, a third side with a third edge, and a fourth side, where the first side is adjacent to the second side and opposite the third side and the second side is opposite the fourth side. Each side includes an opening, where the opening in each side is sized and positioned for receiving forks for lifting the pallet apparatus. The first edge and the third edge are distal to the bottom and the first edge is parallel to the third edge. The pallet apparatus includes a first edge board along the second side connected between the first edge and the third edge and a second edge board along the fourth side connected between the first edge and the third edge. The pallet apparatus includes a deck plate connected to the first edge and the third edge, where the deck plate spans between the first edge board, the second edge board, the first edge and the third edge. The deck plate engages the first edge board and the second edge board at least at a mid-section of the first edge board and the second edge board.

Another pallet apparatus is disclosed and includes a pallet bottom with a bottom, a first side with a first edge, a second side, a third side with a third edge, and a fourth side. The first side is adjacent to the second side and opposite the third side, the second side is opposite the fourth side, each side includes an opening, where the opening in each side is sized and positioned for receiving forks for lifting the pallet apparatus, and the first edge and the third edge are distal to the bottom and the first edge is parallel to the third edge. The pallet apparatus includes a first edge board along the second side connected between the first edge and the third edge, where a horizontal portion of the first edge board is parallel to the bottom and a vertical portion of the first edge board is perpendicular to the bottom, and includes a second edge board along the fourth side connected between the first edge and the third edge, where a horizontal portion of the second edge board is parallel to the bottom and a vertical portion of the first edge board is perpendicular to the bottom.

The pallet apparatus includes a deck plate connected to the first edge and the third edge, where the deck plate spans between the first edge board, the second edge board, the first edge and the third edge. The deck plate includes a first flap extending from an edge of the deck plate running parallel to the first edge board, where the first flap engages the first edge board by extending over the horizontal portion of the first edge board at a mid-section of the first edge board, and the deck plate includes a second flap extending from an edge of the deck plate running parallel to the second edge board, where the second flap engages the second edge board by extending over the horizontal portion of the second edge board at a mid-section of the second edge board. In one embodiment, the first and second edge boards include layers of a wood product in sheet form that are glued together to form an L-shape as a cross section of the first edge board and the second edge board. For example, the wood product may be paper. In another embodiment, the deck plate includes a corrugated fiberboard.

Another pallet apparatus is disclosed that includes a first stringer oriented vertically and positioned on a first side, where a top of the first stringer includes a first edge, and a second stringer oriented vertically and positioned on a third side, where a top of the second stringer includes a third edge. The pallet apparatus includes a first bottom deck board with and edge positioned along a second side and positioned parallel to a bottom of the pallet apparatus and a second bottom deck board with and edge positioned along a fourth side and positioned parallel to the bottom. The first side is adjacent to the second side and opposite the third side, and the second side is opposite the fourth side. Each side includes an opening, where the opening in each side is sized and positioned for receiving forks for lifting the pallet apparatus, and the first edge and the third edge are distal to the bottom and the first edge is parallel to the third edge. The pallet apparatus includes a first edge board along the second side connected between the first edge and the third edge, a second edge board along the fourth side connected between the first edge and the third edge, and a deck plate connected to the first edge and the third edge, where the deck plate spans between the first edge board, the second edge board, the first edge and the third edge. The deck plate engages the first edge board and the second edge board at least at a mid-section of the first edge board and the second edge board.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings.

DETAILED DESCRIPTION OF THE INVENTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

The schematic flowchart diagrams and/or schematic block diagrams in the Figures illustrate the architecture, functionality, and operation of possible implementations. It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Although various arrow types and line types may be employed in the flowchart and/or block diagrams, they are understood not to limit the scope of the corresponding embodiments. Indeed, some arrows or other connectors may be used to indicate only an exemplary logical flow of the depicted embodiment.

The description of elements in each figure may refer to elements of proceeding figures. Like numbers refer to like elements in all figures, including alternate embodiments of like elements.

Figure 1:
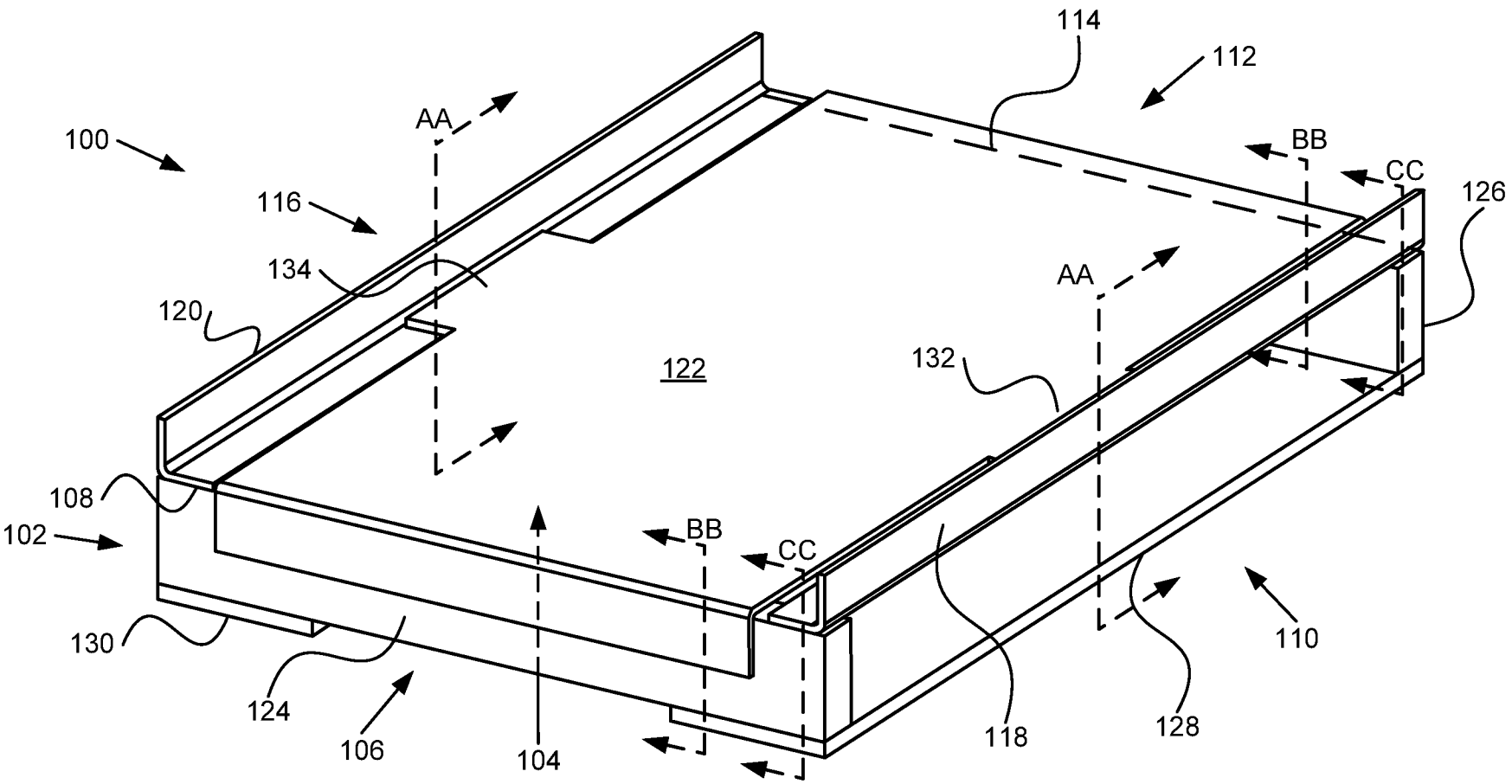
FIG. 1 is a perspective view of a hybrid pallet apparatus in accordance with one embodiment of the present invention.

FIG. 1 is a perspective view of a hybrid pallet apparatus 100 in accordance with one embodiment of the present invention. The pallet apparatus 100 includes a pallet bottom 102 that includes a bottom 104, a first side 106 with a first edge 108, a second side 110, a third side 112 with a third edge 114, and a fourth side 116. Each side of the pallet bottom 102 includes an opening, where the opening in each side 106, 110, 112, 116 is sized and positioned for receiving forks for lifting the pallet apparatus 100. The first edge 108 and the third edge 114 are distal to the bottom 104, and the first edge 108 is parallel to the third edge 114. The pallet apparatus 100 includes a first edge board 118, a second edge board 120 and a deck plate 122, which are described below.

The bottom 104 typically is oriented down when the pallet apparatus 100 is positioned to have material place on the pallet apparatus 100. The pallet bottom 102 is typically sized similar to other pallets and includes openings in each side for forks from a forklift, a pallet jack, or other device for lifting a pallet.

In one embodiment, the pallet bottom 102 includes a first stringer 124, a second stringer 126, a first bottom deck board 128 and a second bottom deck board 130 connected together in a way similar to other pallets. The first stringer 124 is oriented vertically and is positioned on the first side 106, where a top of the first stringer 124 includes the first edge 108. The second stringer 126 is oriented vertically and is positioned on the third side 112, where a top of the second stringer 126 includes the third edge 114. The first bottom deck board 128 includes an edge positioned along the second side 110 and positioned parallel to the bottom 104. The second bottom deck board 130 includes an edge positioned along the fourth side 116 and is positioned parallel to the bottom 104.

The first and second stringers 124, 126 and first and second bottom deck boards 128, 130 often are constructed of wood, such as lumber, such as pine, birch, etc., plywood, particle board, etc. but may also be constructed of other materials, such as plastic, metal, etc. Typically, the first and second stringers 124, 126 and first and second bottom deck boards 128, 130 are connected together, for example with nails, screws, or other fasteners. In other embodiments, the first and second stringers 124, 126 and first and second bottom deck boards 128, 130 may also be pre-formed to be connected. In other embodiments, the pallet bottom 102 may be shaped differently and may be constructed of wood, plastic, particle board, or other material formed into a pallet bottom 102 with openings for forks. For example, the pallet bottom may be formed into a shape with openings for forks and with typical pallet dimensions where the material for forming the shape may be plastic, foam, etc. One of skill in the art will recognize other embodiments of a pallet bottom 102.

The pallet apparatus 100 includes a first edge board 118 and a second edge board 120. The first edge board 118 runs along the second side 110 is connected between the first edge 108 and the third edge 112 and the second edge board 120 runs along the fourth side 116 and is connected between the first edge 108 and the third edge 112. In one embodiment, the first and second edge boards 118, 120 have a cross section that is "L"-shaped where a lower section of each of the first and second edge boards 118, 120 are positioned parallel to the bottom 104 and connect to the pallet bottom 102, for example with staples, nails, screws, glue, etc. An upper section of the first and second edge boards 118, 120 extend away from the pallet bottom 102 along the second side 110 and fourth side 116 respectively.

In one embodiment, the first and second edge boards 118, 120 are an edge board used in shipping and known to those of skill in the art. For example, typical edge boards may be used along the corners of one or more items being shipped and is often oriented vertically. In one embodiment, the first and second edge boards 118, 120 are made of fiberboard, which may also be called cardboard. In some embodiments, the fiberboard is made from layers of paper glued together into the L-shape. The first and second edge boards 118, 120, for example, may be ¼ inch thick edge boards. Other embodiments may be thicker or thinner, where the thickness of the first and second edge boards 118, 120 are determined by a strength requirement where thicker edge boards may be used for heavier loads. In other embodiments, the first and second edge boards 118, 120 are made of a different material, such as plastic, corrugated fiberboard, metal, etc. Typically, the first and second edge boards 118, 120 are sized and a material is chosen for the edge boards based on cost and strength requirements. One of skill in the art will recognize other embodiments of the first and second edge boards 118, 120.

In one embodiment, the pallet apparatus 100 includes a deck plate 122 connected to the first edge 108 and the third edge 114. The deck plate 122 spans between the first edge board 118, the second edge board 120, the first edge 108 and the third edge 114. The deck plate 122 engages the first edge board 118 and the second edge board 120 at least at a mid-section of the first edge board 118 and the second edge board 120.

In one embodiment, as depicted in FIG. 1, the deck plate 122 has a width that is such that the deck plate 122 spans a distance between the first edge board 118 and the second edge board 120 except for a first flap 132 and a second flap 134 in the middle of the deck plate 122 that overlap the first and second edge boards 118, 120, respectively. In one embodiment, the first flap 132 extends from an edge of the deck plate 122 and runs parallel to the first edge board 118 so that the first flap 132 engages the first edge board 118 by extending over the horizontal portion of the first edge board 118 at about the mid-section of the first edge board 118. In the embodiment, the second flap 134 extends from an edge of the deck plate 122 and runs parallel to the second edge board 120 so that the second flap 134 engages the second edge board 120 by extending over the horizontal portion of the second edge board 120 at about the mid-section of the second edge board 120.

With the first and second flaps 132, 134 engaging the first and second edge boards 118, 120 by being situated on top of the first and second edge boards 118, 120, the deck plate 122 is strengthened due to the support received from the first and second edge boards 118, 120. The deck plate 122 is strengthened when engaging the first and second edge boards 118, 120 in part due to the shape of the first and second edge boards 118, 120 where a downward force on the deck plate 122 causes a downward force on the first and second edge boards 118, 120. Due to the shape and position of the first and second edge boards 118, 120 with a vertical portion extending away from the pallet bottom 102, the vertical portion opposes the horizontal portion of the first and second edge boards 118, 120 bending, thus providing support for the deck plate 122. One of skill in the art will recognize reasons why the first and second edge boards 118, 120 provide support for the deck plate 122.

In another embodiment, one or both of the first and second edge boards 118, 120 are positioned upside down of the embodiment of the pallet apparatus 100 shown in FIG. 1. For example, the vertical portion of the first edge board 118 may extend downward along the second side 110 of the pallet bottom 102. For example, if the pallet bottom 102 is a different configuration than the pallet bottom 102 shown in FIG. 1 and includes openings on the second side 110 and fourth side 116 for forks where the openings are below the downward oriented first and second edge boards 118, 120, the forks may engage the pallet bottom 102 instead of the downwardly oriented first and second edge boards 118, 120. The vertical portion of the second edge board 120 may extend downward along the fourth side 116 of the pallet bottom 102. In another embodiment, the pallet apparatus 100 of FIG. 1 may have additional edge boards along the first side 106 and third side 112, for example to help a load on the pallet apparatus 100 from sliding off. One of skill in the art will recognize other ways to use edge boards for the pallet apparatus 100.

In one embodiment, the first and second flaps 132, 134 engage the first and second edge boards 118, 120 by resting on the first and second edge boards 118, 120. In another embodiment, the first and second flaps 132, 134 engage the first and second edge boards 118, 120 by being coupled to the first and second edge boards 118, 120. For example, the first and second flaps 132, 134 may be glued, stapled, or otherwise fastened to the first and second edge boards 118, 120. The width of the first and second flaps 132, 134, in one embodiment, is determined by various factors, such as a weight requirement of the pallet apparatus 100, strength of the material of the deck plate 122, and the like.

In another embodiment, the width of the first and second flaps 132, 134 is sized to allow connection of the deck plate 122 to the first and third edges 108, 114 including flexing of the deck plate 122 based on a thickness of the first and second edge boards 118, 120. For example, if the first and second flaps 132, 134 are wide, there will be more of a bend in the deck plate 122 than if the first and second flaps 132, 134 are not as wide. The bend of the deck plate 122 is discussed further with regard to FIG. 6.

In one embodiment, a horizontal portion of the first edge board 118 is parallel to the bottom 104 and a vertical portion of the first edge board 118 is perpendicular to the bottom 104, and a horizontal portion of the second edge board 120 is parallel to the bottom 104 and a vertical portion of the second edge board 120 is perpendicular to the bottom 104. In another embodiment, the deck plate 122 includes a first flap 132 extending from an edge of the deck plate 122 running parallel to the first edge board 118, where the first flap 132 engages the first edge 118 board by extending over the horizontal portion of the first edge board 118 at the mid-section of the first edge board 118. In the embodiment, the deck plate 122 also includes a second flap 134 extending from an edge of the deck plate 122 running parallel to the second edge board 120, where the second flap 134 engages the second edge board 120 by extending over the horizontal portion of the second edge board 120 at the mid-section of the second edge board 120. In another embodiment, the deck plate 122 extends over the horizontal portion of the first edge board 118 and the horizontal portion of the second edge board 120.

In one embodiment, the deck plate 122 engages the first edge board 118 and the second edge board 120 by overlapping the first edge board 118 and the second edge board 120. In another embodiment, the deck plate 122 engages the first edge board 118 and the second edge board 120 by attaching to the first edge board 118 and to the second edge board 120. In another embodiment, the first edge board 118 and the second edge board 120 include layers of paper glued together to form an L-shape as a cross section of the first edge board 118 and the second edge board 120. In another embodiment, the deck plate 122 includes fiberboard with a burst strength sufficient for an expected load of the pallet apparatus 100. In a further embodiment, the deck plate burst strength is in the range of 125 pounds per square inch (8.788 kilograms per square centimeter) to 700 pounds per square inch (49.21 kilograms per square centimeter). In another further embodiment, the deck plate burst strength is 350 pounds per square inch (24.61 kilograms per square centimeter).

In one embodiment, the fiberboard is a corrugated fiberboard or a honeycomb fiberboard. Where the fiberboard is a corrugated fiberboard, in one embodiment, the fiberboard is a single wall corrugated fiberboard, a double wall corrugated fiberboard or a triple wall corrugated fiberboard. In another embodiment, the deck plate 122 includes a plastic sheet with a burst strength sufficient for an expected load of the pallet apparatus 100. In another embodiment, the deck plate 122 wraps over the first edge 108 and connects to the first edge 108 and the first side 106, and wraps over the third edge 114 and connects to the third edge 114 and the third side 112.

In one embodiment, the pallet bottom 102 includes a first stringer 124 oriented vertically and positioned on the first side 106, where a top of the first stringer 124 comprises the first edge 108, a second stringer 126 oriented vertically and positioned on the third side 112, where a top of the second stringer 126 comprises the third edge 114, a first bottom deck board 128 with an edge positioned along the second side 110 and positioned parallel to the bottom 104, and a second bottom deck board 130 with an edge positioned along the fourth side 116 and positioned parallel to the bottom 104. In a further embodiment, the first stringer 124, the second stringer 126, the first bottom deck board 128 and the second bottom deck board 130 are wood.

The deck plate 122 is typically made of a thin, lightweight material that is typically thinner than traditional deck boards. A thin deck plate 122 is advantageous because the thin deck plate 122 may reduce dimensional weight. For example, if a traditional pallet includes typical deck boards, the deck boards may be ½ inch thick or more and the deck plate 122 of the pallet apparatus 100 may be much thinner, such as ⅛ inch thick. The resulting decrease in thickness will result in a lower height of the pallet apparatus 100 plus load than a pallet using traditional deck boards with the same load. Where shipping costs are based on a dimension of the pallet and load, the resulting lower height would result in a savings.

In one embodiment, the deck plate 122 is made from fiberboard. A pallet apparatus 100 with a fiberboard deck plate 122 may be less expensive than a traditional pallet with deck boards. In addition, the pallet apparatus 100 with a fiberboard deck plate 122 may weigh less than a traditional pallet and thus may allow more load or may be less expensive to ship than a traditional pallet with the same load.

The fiberboard for the deck plate 122 may have a burst strength sized for an expected load. Burst strength may be determined using a bursting test, which may be called a Mullen test. The burst test typically determines an amount of force required to rupture or puncture the face of corrugated board, and is often measured using a Mullen tester. For example, typical burst strengths of fiberboard may range from 125 pounds per square inch ("PSI") or lower to 700 PSI or higher. Typical burst strengths may include 125, 150, 175, 200, 250, 275, 350, 400, 500, 600, 700 PSI. For example, the deck plate 122 may be rated at 350 PSI. The fiberboard may be single face board, single wall board, double wall board, triple wall board, honeycomb, and the like. The fiberboard may have a flute rating, which is a measure of flutes per linear foot, such as A-flute at 36 flutes/linear foot, B-flute at 49 flutes per linear foot, etc. Fluting is typically ranges from A to F. The fluting, corrugation type, etc. may be selected for anticipated loading for the pallet apparatus 100.

In another embodiment, the fiberboard for the deck plate 122 may be have a strength that is characterized by an edge crush strength test ("ECT") rating. An edge crush test is a newer test and is directly related to stacking strength of a carton. ECT is a measure of the edgewise compressive strength of corrugated board. It is typically measured by compressing a small segment of board on edge between two rigid plates perpendicular to the direction of the flutes of the corrugated board until a peak load is established. Often ECT is measured in pounds per lineal inch of load bearing edge. Standard ECT values for single wall corrugated board are 23 ECT, 26 ECT, 29 ECT, 32 ECT, 44 ECT, and 55 ECT, which correspond to 125, 150, 175, 200, 275, and 350 PSI for burst strength. For double wall corrugated board, the standard ECT values are 42 ECT, 48 ECT, 51 ECT, 61 ECT, 71 ECT, and 82 ECT, which correspond to 200, 275, 350, 400, 500, and 600 PSI burst strength. For example, the deck plate 122 may be rated at 350 ECT for double wall corrugated board.

In other embodiments, the deck plate 122 is made of other materials, such as plastic, metal, etc. For example, the deck plate 122 may be made of a plastic corrugated material or a plastic sheet. The material of the deck plate 122 may be chosen based on cost, availability of resources, longevity, durability, weight, strength, etc. One of skill in the art will recognize other materials for a deck plate 122 appropriate for the pallet apparatus 100 that are thinner and/or lighter than typical deck boards.

In one embodiment, the deck plate 122 wraps over the first edge 118 and connects to at least the first side 106 and wraps over the third edge 114 and connects to at least the third side 112. In another embodiment, the deck plate also attached to the first and third edges 108, 114. In the embodiment, the first and third edges 108, 114 include a portion of the pallet bottom 102 interior of an upper corner of the first side 106 and third side 112. For instance, where the pallet bottom 102 includes a first and a second stringer 124, 126, the deck plate 122 may be attached to the top of the stringers 124, 126. The deck plate 122 may also connect to the first and third sides 106, 112. The deck plate 122 may be attached with staples, nails, glue, screws, or other attachment means or any combination thereof. In another embodiment (not shown) the deck plate 122 ends at the first and third edges 108, 114 and is attached to a top of the pallet bottom 102, for example to first and second stringers 124, 126. An embodiment where the deck plate 122 wraps over the first and third edges 108, 114 may be stronger than an embodiment where the deck plate 122 does not extend over the first and third edges 108, 114. An amount that the deck plate 122 wraps over the first and third edges 108, 114, in one embodiment, is determined by strength requirements, friction, convenience of connections, etc. One of skill in the art will recognize when to wrap the deck plate 122 over the first and third edges 108, 114 and how much to wrap.

Figure 2:
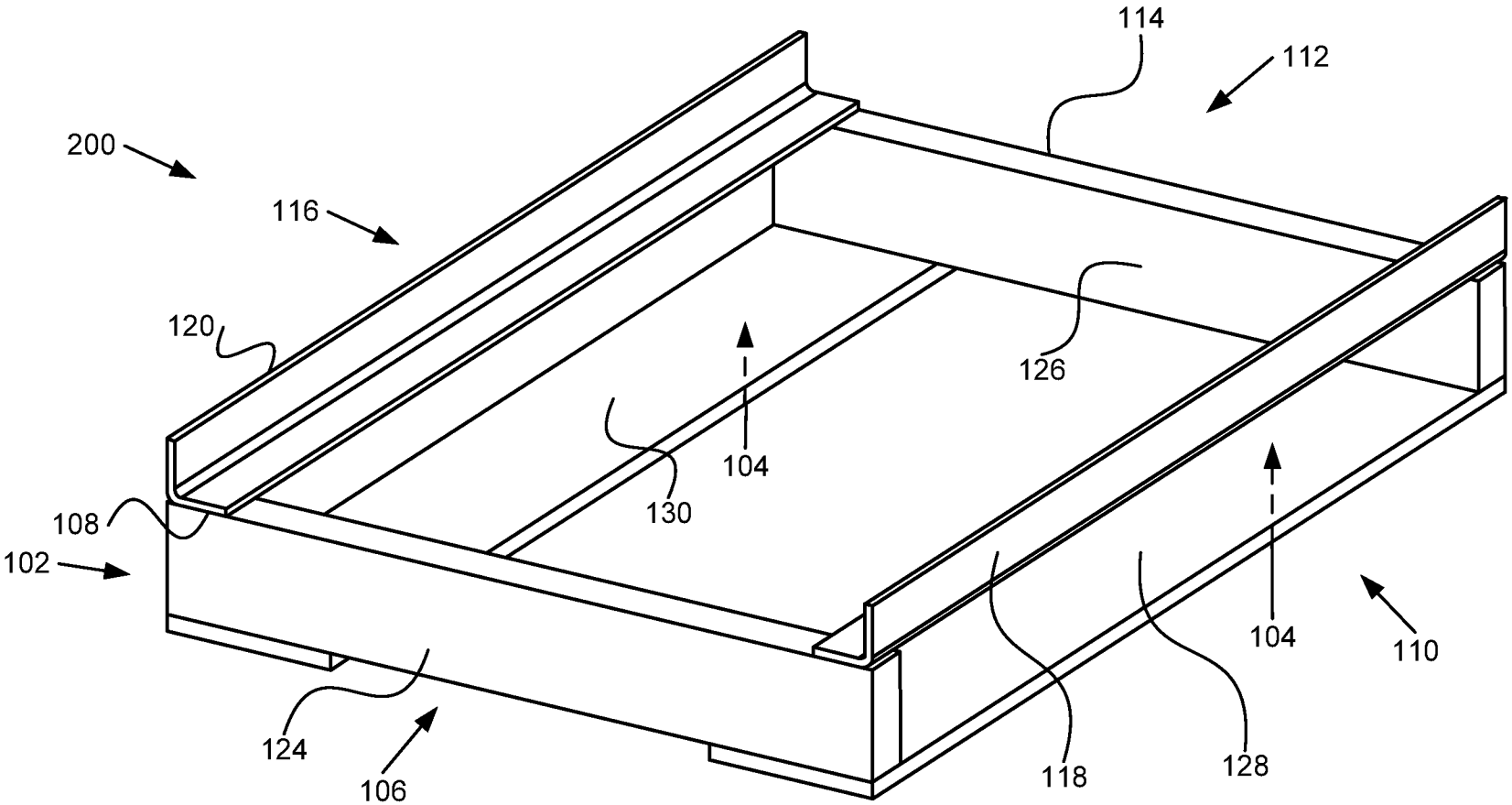
FIG. 2 is a perspective view of a partial pallet apparatus without a deck plate in accordance with one embodiment of the present invention.

FIG. 2 is a perspective view of a partial pallet apparatus 200 without a deck plate 122 in accordance with one embodiment of the present invention. In the embodiment, the partial pallet apparatus 200 includes a first stringer 124, a second stringer 126, a first bottom deck board 128 and a second bottom deck board 130 as described in relation the pallet apparatus 100 of FIG. 1. The partial pallet apparatus 200 also includes a first edge board 118 and a second edge board 120, which are also substantially similar to those described above in relation to the pallet apparatus 100 of FIG. 1. Other depicted numbering also corresponds to the pallet apparatus 100 of FIG. 1. FIG. 2 is included to more clearly show how an embodiment of a pallet apparatus may be constructed.

Figure 3:
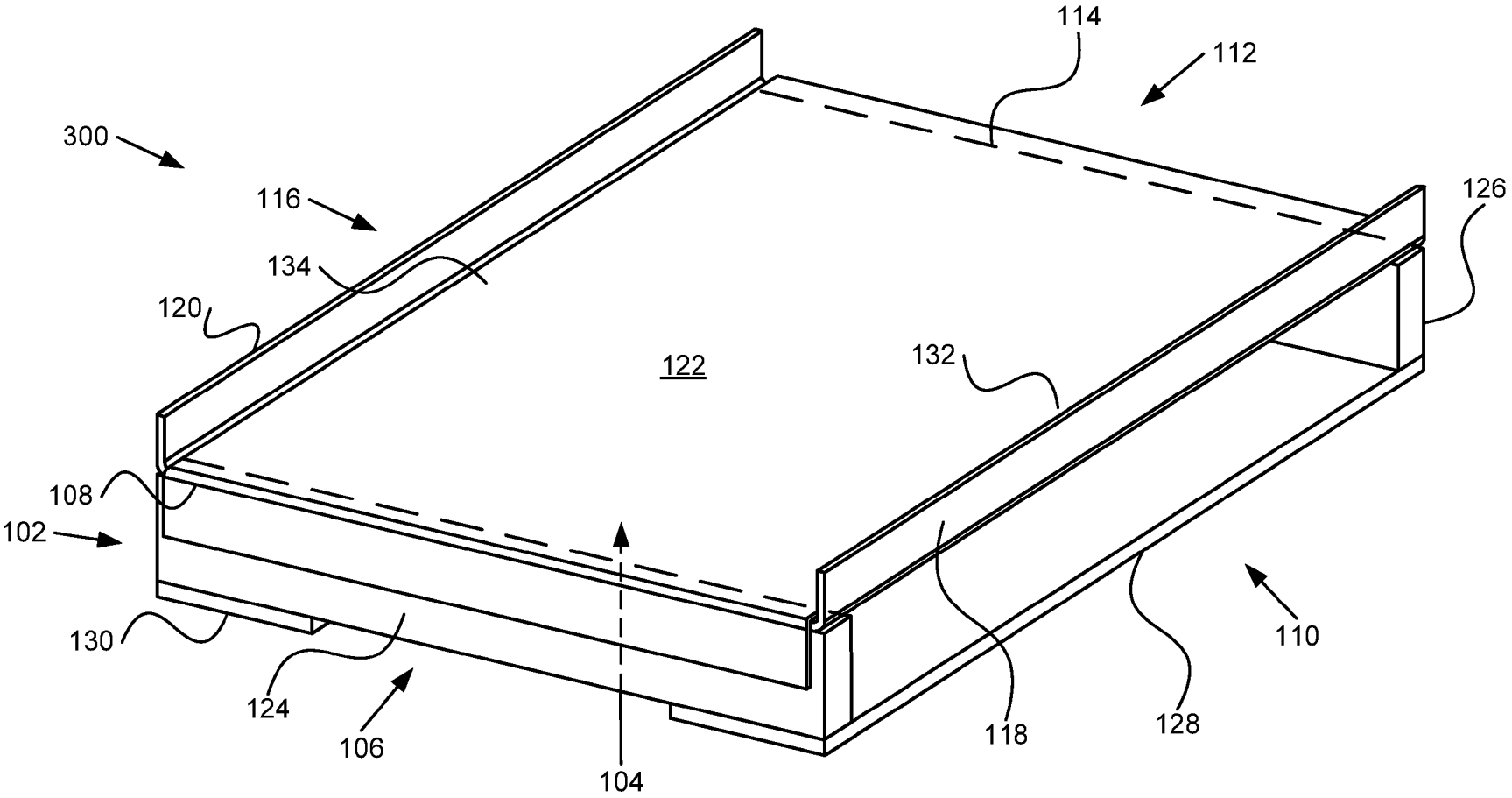
FIG. 3 is a perspective view of an alternate embodiment of a hybrid pallet apparatus in accordance with one embodiment of the present invention.

FIG. 3 is a perspective view of an alternate embodiment of a hybrid pallet apparatus 300 in accordance with one embodiment of the present invention. The pallet apparatus 300 is similar to the pallet apparatus 100 of FIG. 1 except that the first and second flaps 132, 134 that extend over the first and second edge boards 118, 120 extend the entire length of the first and second edge boards 118, 120 and wrap over the first and third edges 108, 114. In the embodiment, the deck plate 122 overlaps the horizontal portion of the first and second edge boards 118, 120. In some embodiments, the deck plate 122 connects to the first and second edge boards 118, 120. In other embodiments, the deck plate 122 merely overlaps the first and second edge boards 118, 120 without connecting to the first and second edge boards 118, 120.

Where the deck plate 122 overlaps the first and second edge boards 118, 120 and wraps around the first and third edges 108, 114 of the pallet bottom 102, the pallet apparatus 300 may accommodate for the thickness of the first and second edge boards 118, 120. For example, the deck plate 122 may be notched or cut along a line near an edge of the first and second edge boards 118, 120 nearest to the center of the pallet apparatus 300. In another example, the pallet apparatus 300 may include a spacer (not shown) along the edge of the pallet bottom 102 along the first and third edges 108, 114 where the spacer may have a thickness that matches the thickness of the first and second edge boards 118, 120. One of skill in the art will recognize other ways to accommodate for a thickness of the first and second edge boards 118, 120 where the deck board 122 overlaps the first and second edge boards 118, 120.

Figure 4A:
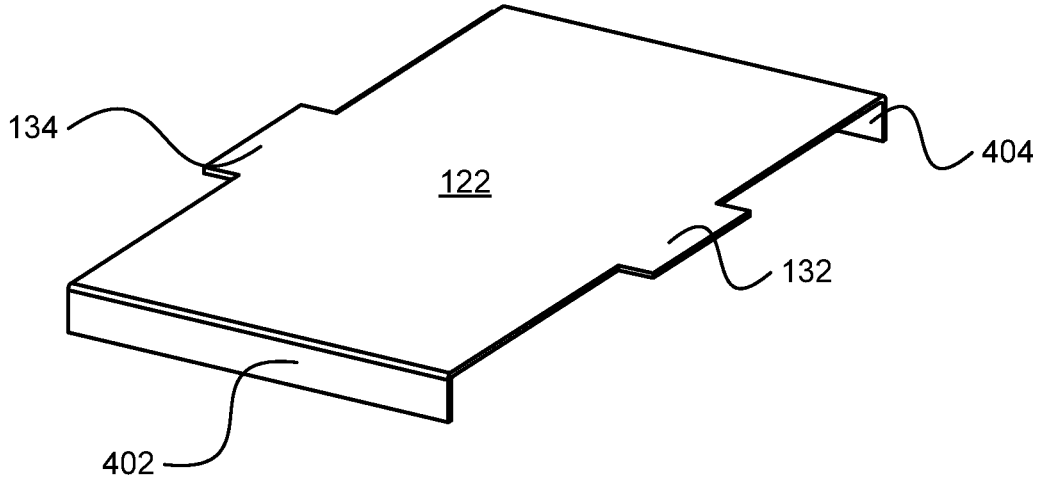
FIG. 4A is a perspective view of a deck plate of a hybrid pallet apparatus in accordance with one embodiment of the present invention.

FIG. 4A is a perspective view of a deck plate 122 of a hybrid pallet apparatus in accordance with one embodiment of the present invention. The deck board 122 is substantially similar to the deck board 122 shown in the pallet apparatus 100 of FIG. 1. The deck plate 122 includes a first flap 132 and a second flap 134 that overlap the first and second edge boards 118, 120, respectively. The deck plate 122 includes a flap 402 that wraps over the first edge 108 and a flap 404 that wraps over the third edge 114 of the pallet bottom 102.

Figure 4B:
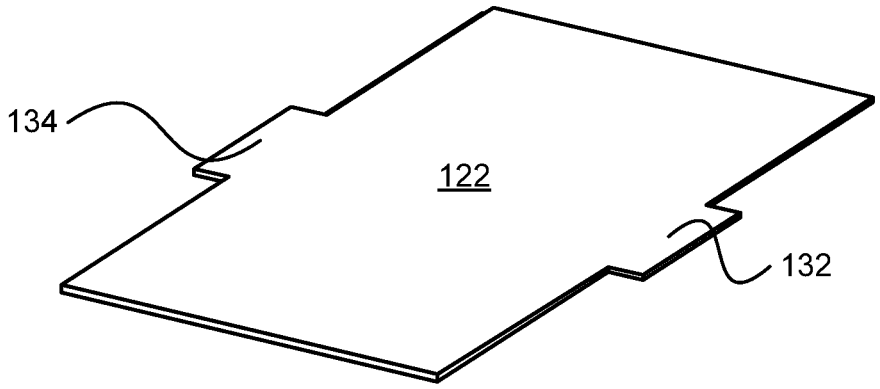
FIG. 4B is a perspective view of an alternate embodiment of a deck plate of a hybrid pallet apparatus in accordance with one embodiment of the present invention.

FIG. 4B is a perspective view of an alternate embodiment of a deck plate 122 of a hybrid pallet apparatus in accordance with one embodiment of the present invention. The embodiment is substantially similar to the embodiment of the deck plate 122 of FIG. 4A except that the embodiment of the deck plate 122 does not include flaps 402, 404 and attaches to a top of the pallet bottom 102 without wrapping over the first edge 108 and the third edge 114.

Figure 5:
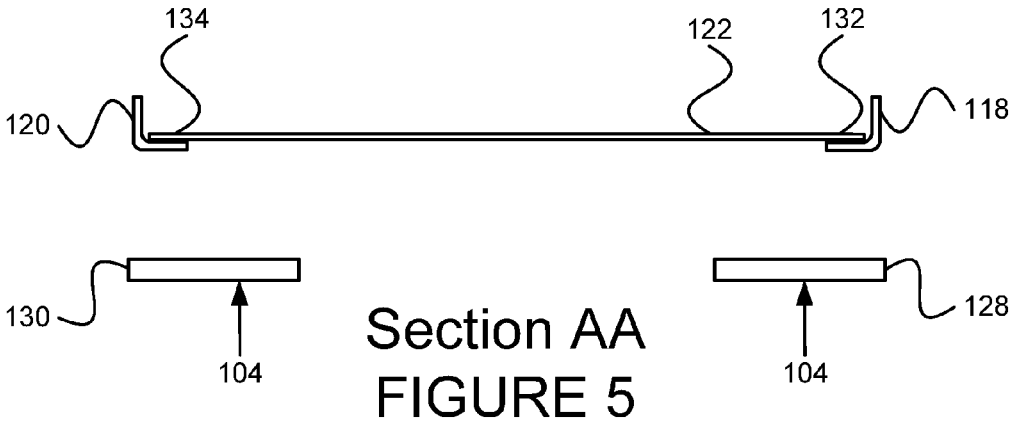
FIG. 5 is a section AA of the embodiment of the hybrid pallet apparatus of FIG. 1.

FIG. 5 is a section AA of the embodiment of the hybrid pallet apparatus 100 of FIG. 1. Section AA is through the first flap 132 and second flap 134 of the deck plate 122. In the embodiment, the pallet bottom 102 includes a first bottom deck board 128 and a second bottom deck board 130, which may be pine, plywood, etc. and may be rectangular as shown. Section AA depicts how the first flap 132 extends over the first edge board 118 and second flap 134 extends over the second edge board 120.

Figure 6:
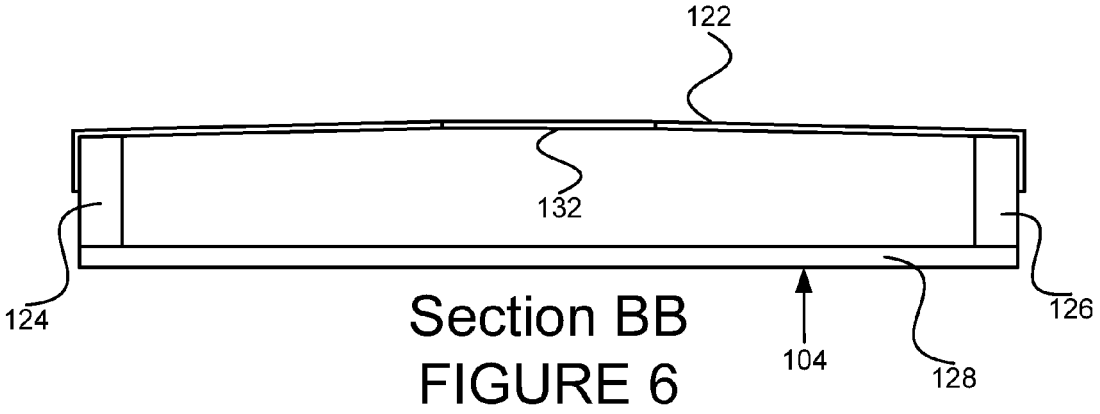
FIG. 6 is a section BB of the embodiment of the hybrid pallet apparatus of FIG. 1.

FIG. 6 is a section BB of the embodiment of the hybrid pallet apparatus 100 of FIG. 1. Section BB is perpendicular to section AA and is near where the first flap 132 overlaps the first edge board 118. The deck plate 122 slopes slightly toward the first and second stringers 124, 126, which are connected to the first bottom deck board 128. In another embodiment, a pallet apparatus includes a spacer (not shown) between the deck plate 122 and the first and second stringers 124, 126 so that the deck plate 122 is flat or nearly flat.

Figure 7:
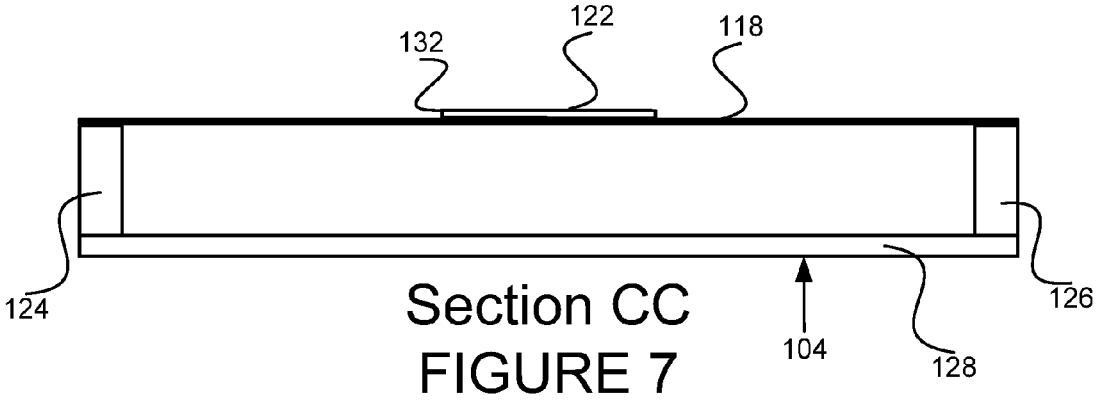
FIG. 7 is a section CC of the embodiment of the hybrid pallet apparatus of FIG. 1.

FIG. 7 is a section CC of the embodiment of the hybrid pallet apparatus 100 of FIG. 1. Section CC is a section taken through the horizontal portion of the first edge board 118 and depicts the first flap 132 extending over the first edge board 118. As the first edge board 118 increases in thickness, the deck plate 122 may have an increase in the slope depicted in FIG. 6.

While several embodiments are depicted in FIGS. 1-3, 4A, 4B, 5-7, and FIGS. 1-3 and 5-7 depict typical stringers 124, 126 and bottom deck boards 128, 130, one of skill in the art will recognize other pallet bottoms that may include a deck plate 122 and first and second edge boards 118, 120 as described herein. The embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A pallet apparatus comprising:

a pallet bottom comprising:

a bottom, a first side having a first stringer oriented vertically, and a top of said first stringer defining a first uppermost surface, a second side, a third side having a second stringer oriented vertically, and a top of said second stringer defining a third uppermost surface, and a fourth side, the first side adjacent to the second side and opposite the third side, the second side opposite the fourth side, each side comprising an opening, the opening in each side sized and positioned for receiving forks for lifting the pallet apparatus, the first surface and the third surface distal to the bottom, the first surface parallel to the third surface;

a first edge board along the second side connected directly to the first surface and directly to the third surface;

a second edge board along the fourth side connected directly to the first surface and directly to the third surface; and a deck plate connected directly to the first surface and directly to the third surface, the deck plate spanning between the first edge board, the second edge board, the first surface and the third surface, wherein the deck plate engages the first edge board and the second edge board at least at a mid-section of the first edge board and the second edge board; wherein a horizontal portion of the first edge board is parallel to the bottom and a vertical portion of the first edge board is perpendicular to the bottom and extends above an uppermost surface of the deck plate.

2. The apparatus of claim 1, wherein a horizontal portion of the second edge board is parallel to the bottom and a vertical portion of the second edge board is perpendicular to the bottom.

3. The apparatus of claim 2, wherein the deck plate comprises a first flap extending from an edge of the deck plate running parallel to the first edge board, wherein the first flap engages the first edge board by extending over the horizontal portion of the first edge board at the mid-section of the first edge board, and the deck plate comprises a second flap extending from an edge of the deck plate running parallel to the second edge board, wherein the second flap engages the second edge board by extending over the horizontal portion of the second edge board at the mid-section of the second edge board.

4. The apparatus of claim 2, wherein the deck plate extends over the horizontal portion of the first edge board and the horizontal portion of the second edge board.

5. The apparatus of claim 1, wherein the deck plate engages the first edge board and the second edge board by overlapping the first edge board and the second edge board.

6. The apparatus of claim 1, wherein the deck plate engages the first edge board and the second edge board by attaching to the first edge board and to the second edge board.

7. The apparatus of claim 1, wherein the first edge board and the second edge board comprise layers of paper glued together to form an L-shape as a cross section of the first edge board and the second edge board.

8. The apparatus of claim 1, wherein the deck plate comprises fiberboard with a burst strength sufficient for an expected load of the pallet apparatus.

9. The apparatus of claim 8, wherein the deck plate burst strength is in a range of 125 pounds per square inch (8.788 kilograms per square centimeter) to 700 pounds per square inch (49.21 kilograms per square centimeter).

10. The apparatus of claim 9, wherein the deck plate burst strength is 350 pounds per square inch (24.61 kilograms per square centimeter).

11. The apparatus of claim 8, wherein the fiberboard is one of a corrugated fiberboard and a honeycomb fiberboard.

12. The apparatus of claim 11, wherein the fiberboard comprises a corrugated fiberboard and is one of a single wall corrugated fiberboard, a double wall corrugated fiberboard and a triple wall corrugated fiberboard.

13. The apparatus of claim 1, wherein the deck plate comprises plastic sheet with a burst strength sufficient for an expected load of the pallet apparatus.

14. The apparatus of claim 1, wherein the deck plate wraps over the first surface and connects to a side surface of the first side and wraps over the third surface and connects to a side surface of the third side.

15. The apparatus of claim 1, wherein the pallet bottom comprises:

a first bottom deck board with an edge positioned along the second side and positioned parallel to the bottom; and a second bottom deck board with an edge positioned along the fourth side and positioned parallel to the bottom.

16. The apparatus of claim 15, wherein the first stringer, the second stringer, the first bottom deck board and the second bottom deck board are wood.

17. A pallet apparatus comprising:

a pallet bottom comprising a bottom, a first side having a first stringer oriented vertically, and a top of said first stringer defining a first uppermost surface, a second side, a third side having a second stringer oriented vertically, and a top of said second stringer defining a third uppermost surface, and a fourth side, the first side adjacent to the second side and opposite the third side, the second side opposite the fourth side, each side comprising an opening, the opening in each side sized and positioned for receiving forks for lifting the pallet apparatus, the first surface and the third surface distal to the bottom, the first surface parallel to the third surface;

a first edge board along the second side connected directly to the first surface and directly to the third surface, a horizontal portion of the first edge board is parallel to the bottom and a vertical portion of the first edge board is perpendicular to the bottom;

a second edge board along the fourth side connected directly to the first surface and directly to the third surface, a horizontal portion of the second edge board is parallel to the bottom and a vertical portion of the first edge board is perpendicular to the bottom; and a deck plate connected directly to the first surface and directly to the third surface, the deck plate spanning between the first edge board, the second edge board, the first surface and the third surface, the deck plate comprising a first flap extending from an edge of the deck plate running parallel to the first edge board, wherein the first flap engages the first edge board by extending over the horizontal portion of the first edge board at a mid-section of the first edge board, and the deck plate comprising a second flap extending from an edge of the deck plate running parallel to the second edge board, wherein the second flap engages the second edge board by extending over the horizontal portion of the second edge board at a mid-section of the second edge board; wherein a horizontal portion of the first edge board is parallel to the bottom and a vertical portion of the first edge board is perpendicular to the bottom and extends above an uppermost surface of the deck plate.

18. The apparatus of claim 17, wherein the first and second edge boards comprise layers of a wood product in sheet form that are glued together to form an L-shape as a cross section of the first edge board and the second edge board.

19. The apparatus of claim 17, wherein the deck plate comprises a corrugated fiberboard.

* * * * *